US011038254B2

(12) United States Patent
Chang et al.

(10) Patent No.: US 11,038,254 B2
(45) Date of Patent: Jun. 15, 2021

(54) MOBILE DEVICE

(71) Applicant: Acer Incorporated, New Taipei (TW)

(72) Inventors: Kun-Sheng Chang, New Taipei (TW); Ching-Chi Lin, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 16/577,061

(22) Filed: Sep. 20, 2019

(65) Prior Publication Data

US 2021/0044000 A1 Feb. 11, 2021

(30) Foreign Application Priority Data

Aug. 6, 2019 (TW) ..... 108127855

(51) Int. Cl.
*H01Q 1/24* (2006.01)
*H01Q 5/30* (2015.01)
*H01Q 1/38* (2006.01)

(52) U.S. Cl.
CPC ..... *H01Q 1/24* (2013.01); *H01Q 1/38* (2013.01); *H01Q 5/30* (2015.01)

(58) Field of Classification Search
CPC .. H01Q 1/24; H01Q 5/30; H01Q 1/38; H01Q 5/385; H01Q 5/35
USPC ..... 343/702
See application file for complete search history.

(56) References Cited

U.S. PATENT DOCUMENTS 6,448,932 B1 * 9/2002 Stoiljkovic ..... H01Q 1/243 343/700 MS
2004/0080457 A1 * 4/2004 Guo ..... H01Q 5/371 343/700 MS
2008/0246678 A1 * 10/2008 Rao ..... H01Q 13/10 343/770
2009/0009401 A1 * 1/2009 Suzuki ..... H01Q 9/42 343/700 MS (Continued)

FOREIGN PATENT DOCUMENTS

TW 201507282 A 2/2015

OTHER PUBLICATIONS

Chinese language office action dated Mar. 11, 2020, issued in application No. TW 108127855.

*Primary Examiner* — Dimary S Lopez Cruz
*Assistant Examiner* — Yonchan J Kim
(74) *Attorney, Agent, or Firm* — McClure, Qualey & Rodack, LLP

(57) ABSTRACT

A mobile device includes a common ground element, a connection element, a first radiation element, a second radiation element, a third radiation element, a fourth radiation element, and a dielectric substrate. The first radiation element has a first feeding point. The first radiation element is coupled through the connection element to the common ground element. The second radiation element is coupled to the first feeding point. The second radiation element is at least partially surrounded by the first radiation element. The third radiation element has a second feeding point. The fourth radiation element is adjacent to the third radiation element. The fourth radiation element is coupled to the common ground element. An antenna structure disposed on the dielectric substrate is formed by the common ground element, the connection element, the first radiation element, (Continued)

the second radiation element, the third radiation element, and the fourth radiation element.

13 Claims, 7 Drawing Sheets

(56) References Cited

U.S. PATENT DOCUMENTS

| | | | | |
|---|---|---|---|---|
| 2012/0242555 | A1 | 9/2012 | Hsieh et al. | |
| 2014/0256388 | A1 | 9/2014 | Lin et al. | |
| 2016/0352013 | A1* | 12/2016 | Fan | H01Q 9/0421 |

* cited by examiner

MOBILE DEVICE

CROSS REFERENCE TO RELATED APPLICATIONS

This application claims priority of Taiwan Patent Application No. 108127855 filed on Aug. 6, 2019, the entirety of which is incorporated by reference herein.

BACKGROUND OF THE INVENTION

Field of the Invention

The disclosure generally relates to a mobile device, and more particularly, it relates to a mobile device and an antenna structure therein.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna for signal reception and transmission has insufficient bandwidth, it will degrade the communication quality of the relative mobile device. Accordingly, it has become a critical challenge for antenna designers to design a wideband antenna element that is small in size.

BRIEF SUMMARY OF THE INVENTION

In an exemplary embodiment, the disclosure is directed to a mobile device which includes a common ground element, a connection element, a first radiation element, a second radiation element, a third radiation element, a fourth radiation element, and a dielectric substrate. The common ground element is coupled to a ground voltage. The first radiation element has a first feeding point. The first radiation element is coupled through the connection element to the common ground element. The second radiation element is coupled to the first feeding point. The second radiation element is at least partially surrounded by the first radiation element. The third radiation element has a second feeding point. The fourth radiation element is disposed adjacent to the third radiation element. The fourth radiation element is coupled to the common ground element. An antenna structure is formed by the common ground element, the connection element, the first radiation element, the second radiation element, the third radiation element, and the fourth radiation element. The antenna structure is disposed on the dielectric substrate.

In some embodiments, the common ground element substantially has a straight-line shape.

In some embodiments, the common ground element has a first side and a second side which are opposite to each other. The connection element, the first radiation element, and the second radiation element are disposed adjacent to the first side of the common ground element. The third radiation element and the fourth radiation element are disposed adjacent to the second side of the common ground element.

In some embodiments, the first radiation element substantially has an inverted U-shape defining a notch region. The second radiation element is disposed inside the notch region.

In some embodiments, the fourth radiation element is separate from the third radiation element. A coupling gap is formed between the third radiation element and the fourth radiation element.

In some embodiments, the antenna structure covers a first frequency band, a second frequency band, a third frequency band, and a fourth frequency band. The first frequency band is from 1710 MHz to 2170 MHz. The second frequency band is from 2300 MHz to 2700 MHz. The third frequency band is from 2400 MHz to 2500 MHz. The fourth frequency band is from 5150 MHz to 5850 MHz.

In some embodiments, the first radiation element is excited to generate the first frequency band. The length of the first radiation element is substantially equal to 0.25 wavelength of the first frequency band.

In some embodiments, the second radiation element is excited to generate the second frequency band. The length of the second radiation element is substantially equal to 0.25 wavelength of the second frequency band.

In some embodiments, the fourth radiation element and the common ground element are excited to generate the third frequency band. The total length of the fourth radiation element and the common ground element is substantially equal to 0.25 wavelength of the third frequency band.

In some embodiments, the third radiation element is excited to generate the fourth frequency band. The length of the third radiation element is substantially equal to 0.25 wavelength of the fourth frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
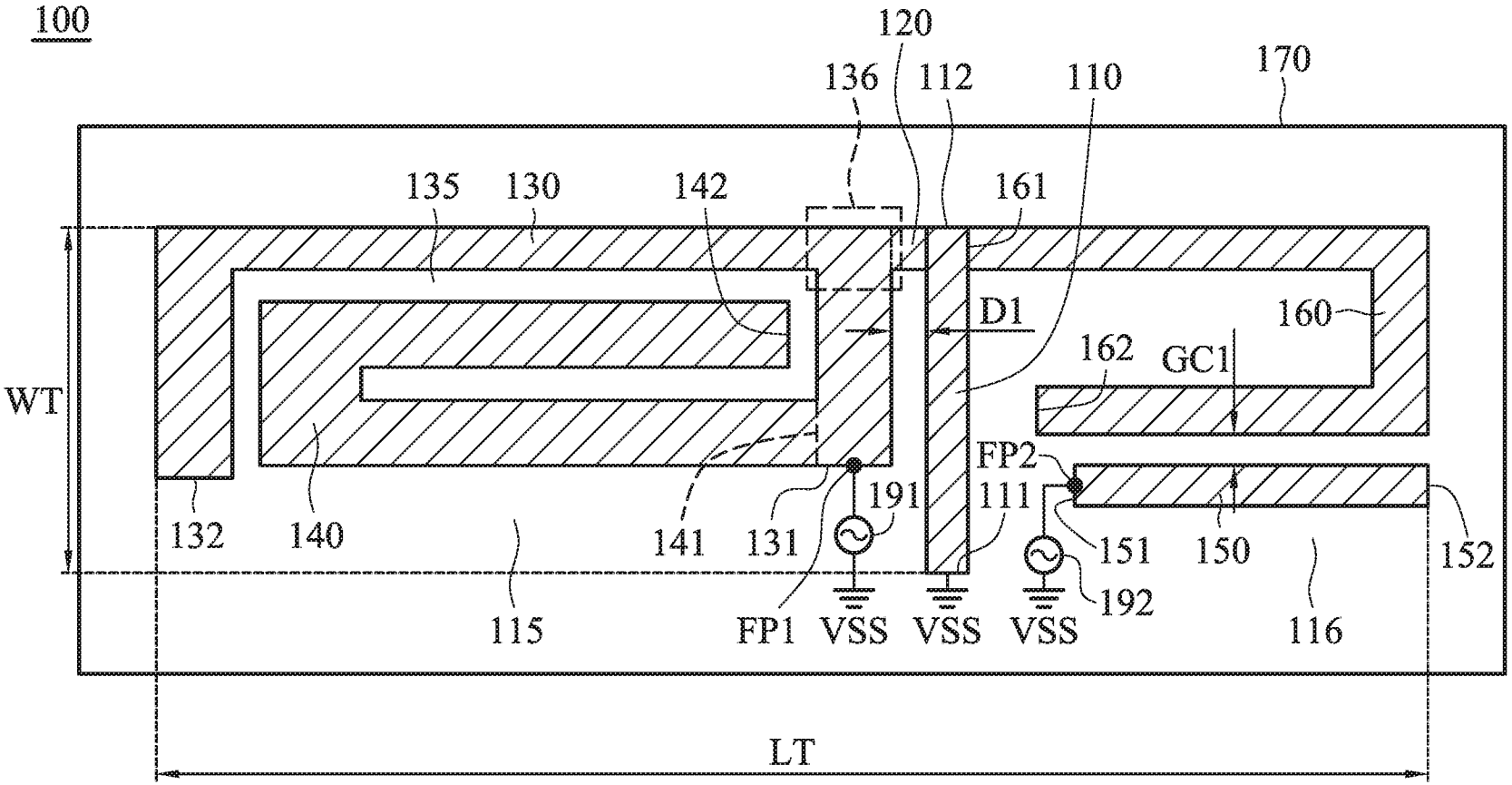
FIG. 1 is a top view of a mobile device according to an embodiment of the invention.

FIG. 1 is a top view of a mobile device 100 according to an embodiment of the invention. For example, the mobile device 100 may be a smart phone, a tablet computer, or a notebook computer. As shown in FIG. 1, the mobile device 100 at least includes a common ground element 110, a connection element 120, a first radiation element 130, a second radiation element 140, a third radiation element 150, a fourth radiation element 160, and a dielectric substrate 170. The common ground element 110, the connection element 120, the first radiation element 130, the second radiation element 140, the third radiation element 150, and the fourth radiation element 160 may be made of metal materials, such as copper, silver, aluminum, iron, or their alloys. The dielectric substrate 170 may be an FR4 (Flame Retardant 4) substrate, a PCB (Printed Circuit Board), or an FCB (Flexible Circuit Board). It should be understood that the mobile device 100 may further include other components, such as a display device, a speaker, a touch control module, a power supply module, and a housing, although they are not displayed in FIG. 1.

The common ground element 110 may substantially have a straight-line shape. The common ground element 110 has a first end 111 and a second end 112. The first end 111 of the common ground element 110 is coupled to a ground voltage VSS. For example, the ground voltage VSS may be provided by a system ground plane (not shown) of the mobile device 100. Specifically, the common ground element 110 has a first side 115 and a second side 116 which are opposite to each other. The connection element 120, the first radiation element 130, and the second radiation element 140 are all disposed adjacent to the first side 115 (e.g., the left side) of the common ground element 110. The third radiation element 150 and the fourth radiation element 160 are both disposed adjacent to the second side 116 (e.g., the right side) of the common ground element 110. It should be noted that both the first radiation element 130 and the fourth radiation element 160 are coupled through the common ground element 110 to the ground voltage VSS.

The connection element 120 may substantially have a rectangular shape or a square shape. The first radiation element 130 may substantially have an inverted U-shape defining a notch region 135. The notch region 135 may substantially have a rectangular shape. The whole second radiation element 140 may be disposed inside the notch region 135 of the first radiation element 130. The first radiation element 130 has a first feeding point FP1. The first feeding point FP1 may be coupled to a first signal source 191. Specifically, the first radiation element 130 has a first end 131 and a second end 132. The first feeding point FP1 is positioned at the first end 131 of the first radiation element 130. The second end 132 of the first radiation element 130 is an open end. In addition, a bending portion 136 of the first radiation element 130 may be coupled through the connection element 120 to the second end 112 of the common ground element 110.

The second radiation element 140 may substantially have a C-shape. The second radiation element 140 is at least partially surrounded by the first radiation element 130. Specifically, the second radiation element 140 has a first end 141 and a second end 142. The first end 141 of the second radiation element 140 is coupled to the first feeding point FP1 and the first end 131 of the first radiation element 130. The second end 142 of the second radiation element 140 is an open end. In addition, the second end 142 of the second radiation element 140 is adjacent to the bending portion 136 of the first radiation element 130. It should be noted that the term "adjacent" or "close" over the disclosure means that the distance (spacing) between two corresponding elements is smaller than a predetermined distance (e.g., 5 mm or shorter), but usually does not mean that the two corresponding elements directly touch each other (i.e., the aforementioned distance/spacing therebetween is reduced to 0).

The third radiation element 150 may substantially have a straight-line shape, and it may be substantially perpendicular to the common ground element 110. The third radiation element 150 has a second feeding point FP2. The second feeding point FP2 may be coupled to a second signal source 192. Specifically, the third radiation element 150 has a first end 151 and a second end 152. The second feeding point FP2 is positioned at the first end 151 of the third radiation element 150. The second end 152 of the third radiation element 150 is an open end, which extends away from the common ground element 110.

The fourth radiation element may substantially have an inverted C-shape, and it may be at least partially perpendicular to the common ground element 110 and is at least partially parallel to the third radiation element 150. The fourth radiation element 160 is adjacent to the third radiation element 150 and is separate from the third radiation element 150. A coupling gap GC1 is formed between the third radiation element 150 and the fourth radiation element 160. Specifically, the fourth radiation element 160 has a first end 161 and a second end 162. The first end 161 of the fourth radiation element 160 is coupled to the second end 112 of the common ground element 110. The second end 162 of the fourth radiation element 160 is an open end, which extends toward the common ground element 110.

In some embodiments, an antenna structure is formed by the common ground element 110, the connection element 120, the first radiation element 130, the second radiation element 140, the third radiation element 150, and the fourth radiation element 160. Such an antenna structure is planar and is disposed on a surface of the dielectric substrate 170.

Figure 2:
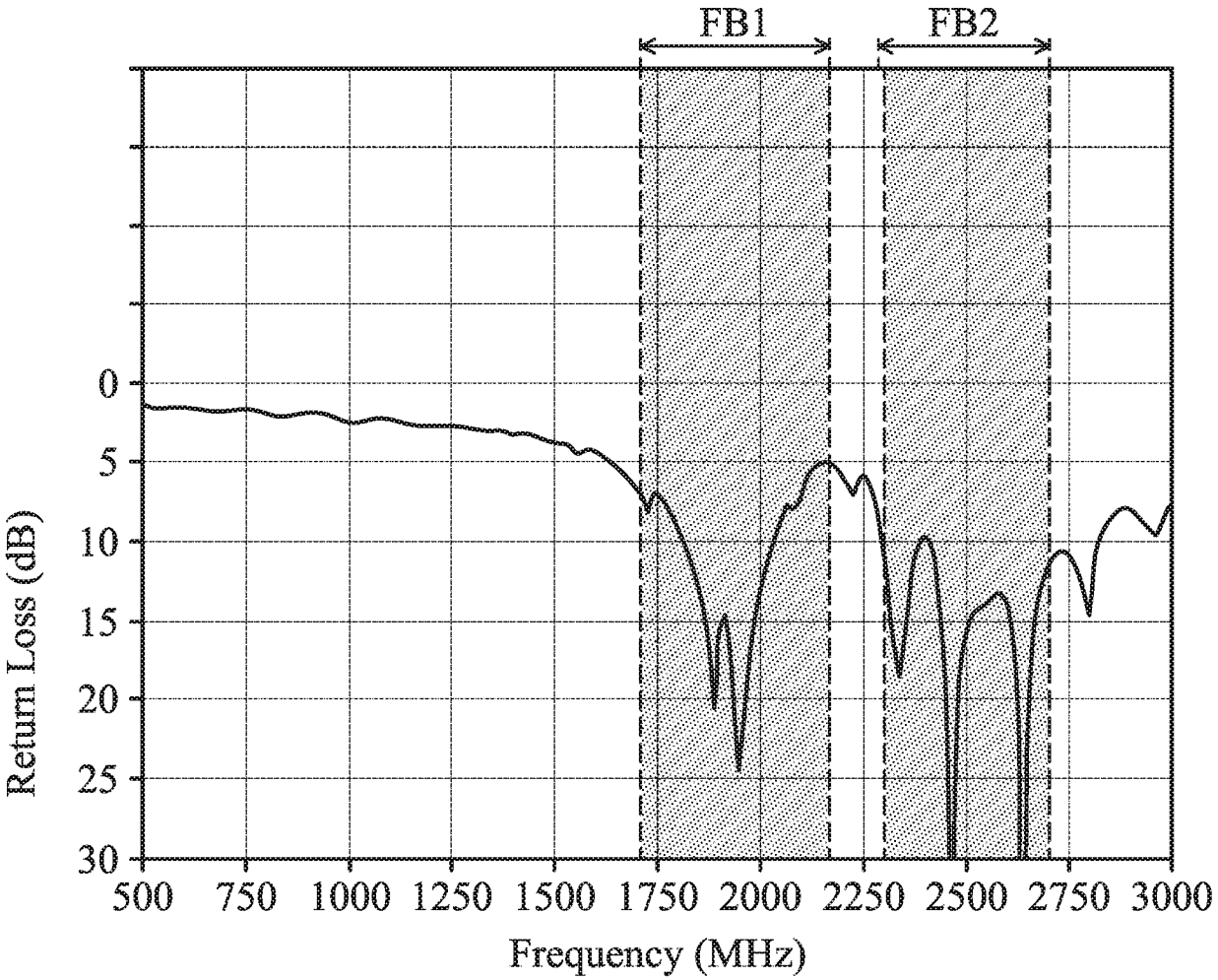
FIG. 2 is a diagram of return loss of an antenna structure of a mobile device according to an embodiment of the invention.

FIG. 2 is a diagram of return loss of the antenna structure of the mobile device 100 according to an embodiment of the invention. The horizontal axis represents the operation frequency (MHz), and the vertical axis represents the return loss (dB). According to the measurement of FIG. 2, when being excited by the first signal source 191, the antenna structure of the mobile device 100 can cover a first frequency band FB1 and a second frequency band FB2. The first frequency band FB1 may be from 1710 MHz to 2170 MHz. The second frequency band FB2 may be from 2300 MHz to 2700 MHz. Therefore, the antenna structure of the mobile device 100 can support at least the dual-band MIMO (Multi-Input and Multi-Output) operations of WWAN (Wireless Wide Area Network).

Figure 3:
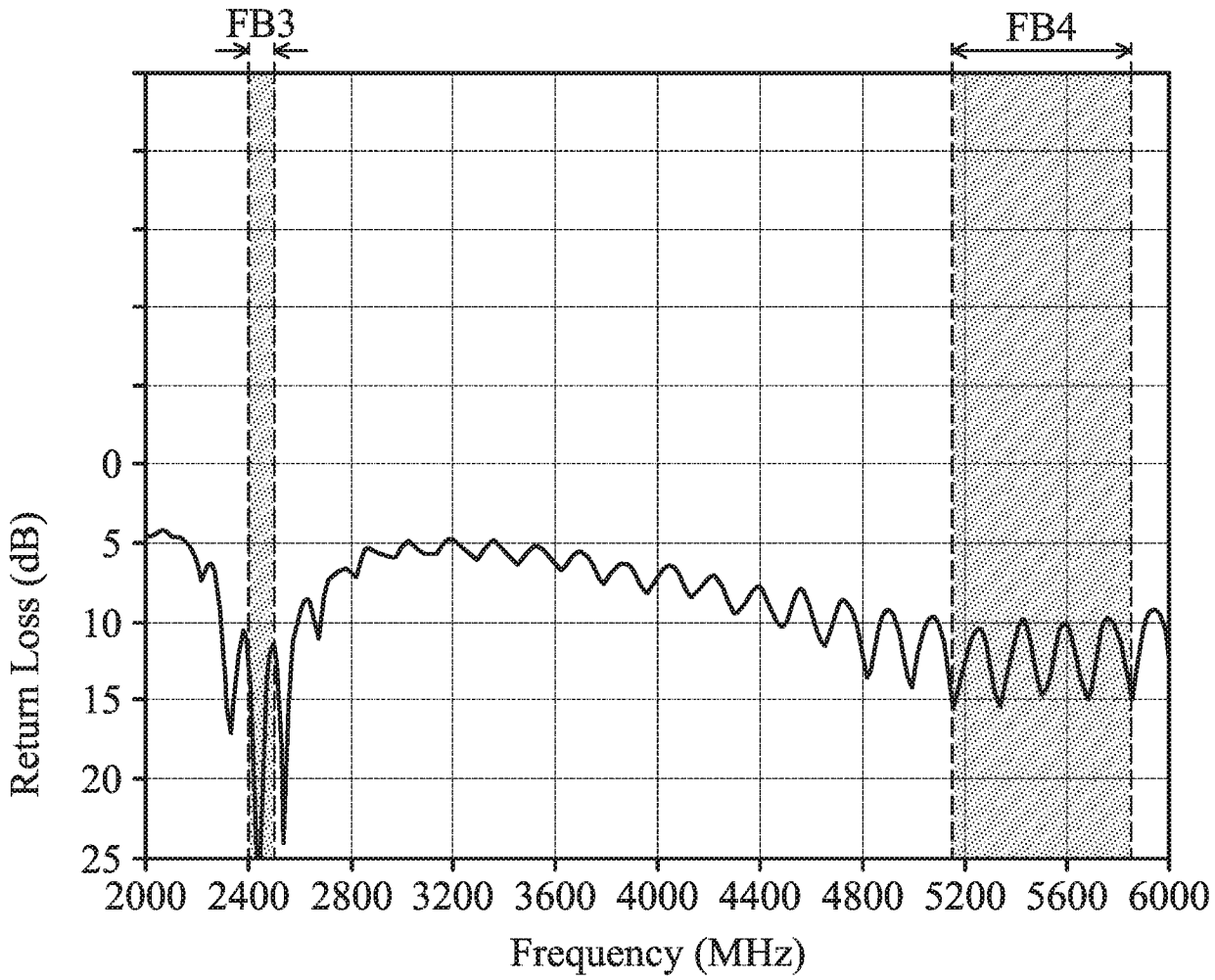
FIG. 3 is a diagram of return loss of an antenna structure of a mobile device according to an embodiment of the invention.

FIG. 3 is a diagram of return loss of the antenna structure of the mobile device 100 according to an embodiment of the invention. The horizontal axis represents the operation frequency (MHz), and the vertical axis represents the return loss (dB). According to the measurement of FIG. 3, when being excited by the second signal source 192, the antenna structure of the mobile device 100 can cover a third frequency band FB3 and a fourth frequency band FB4. The third frequency band FB3 may be from 2400 MHz to 2500 MHz. The fourth frequency band FB4 may be from 5150 MHz to 5850 MHz. Therefore, the antenna structure of the mobile device 100 can support at least the dual-band operations of WLAN (Wireless Local Area Network) 2.4 GHz/5 GHz.

In some embodiments, the operation principles of the antenna structure of the mobile device 100 are described as follows. The first radiation element 130 is excited to generate the first frequency band FB1. The second radiation element 140 is excited to generate the second frequency band FB2. The fourth radiation element 160 and the common ground element 110 are excited to generate the third frequency band FB3. The third radiation element 150 is excited to generate the fourth frequency band FB4. According to practical measurements, the common ground element 110 is used as a grounding resonant path of the third frequency band FB3, and it is also configured to fine-tune the impedance matching of the first frequency band FB1 and the second frequency band FB2. Therefore, the incorporation of the common ground element 110 helps to minimize the total size of the antenna structure of the mobile device 100.

Figure 4:
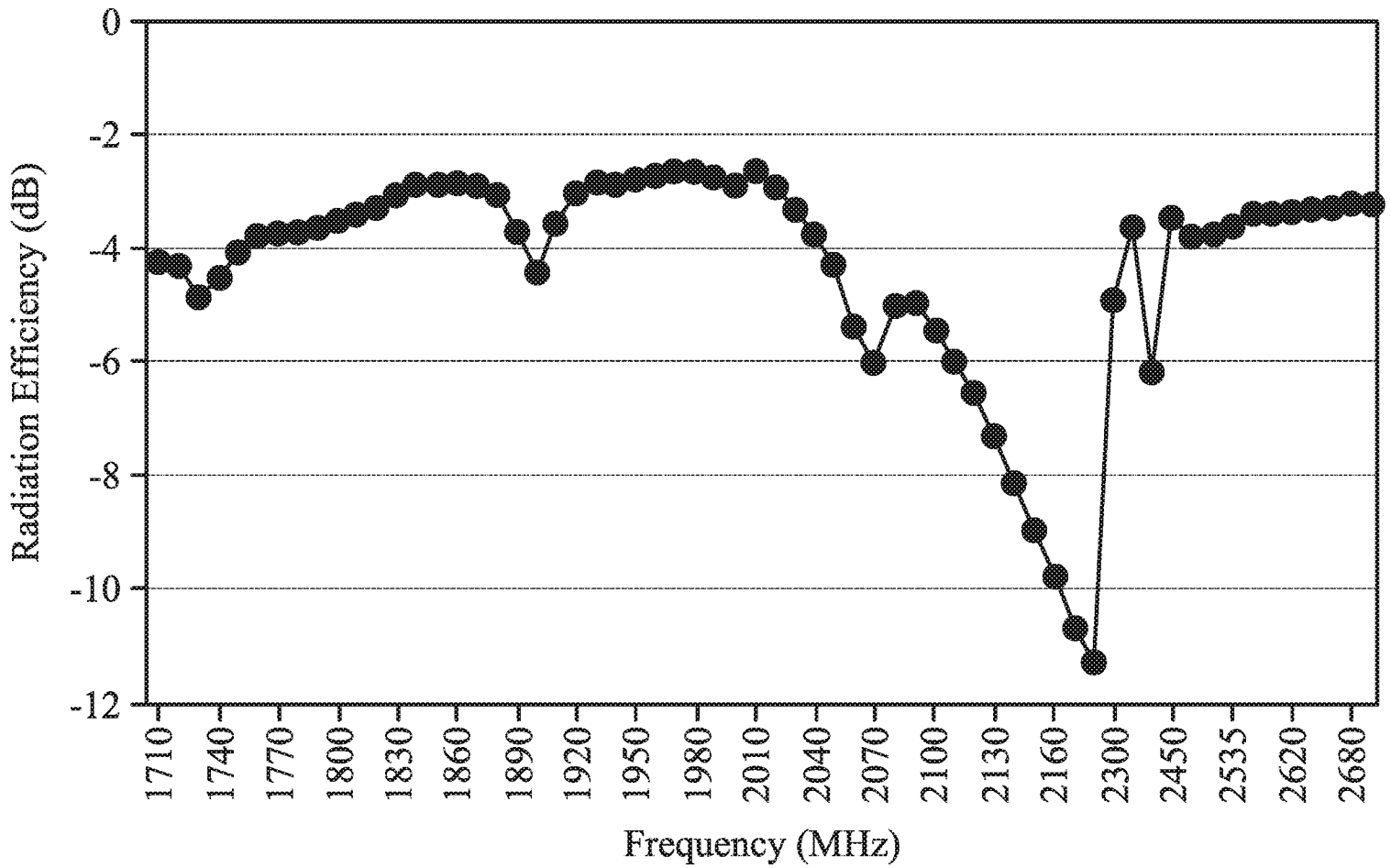
FIG. 4 is a diagram of radiation efficiency of an antenna structure of a mobile device according to an embodiment of the invention.

FIG. 4 is a diagram of radiation efficiency of the antenna structure of the mobile device 100 according to an embodiment of the invention. The horizontal axis represents the operation frequency (MHz), and the vertical axis represents the radiation efficiency (dB). According to the measurement of FIG. 4, the radiation efficiency of the antenna structure of the mobile device 100 can reach −4 dB within the first frequency band FB1 and the second frequency band FB2, and it can meet the requirement of practical application of general WWAN communication.

Figure 5:
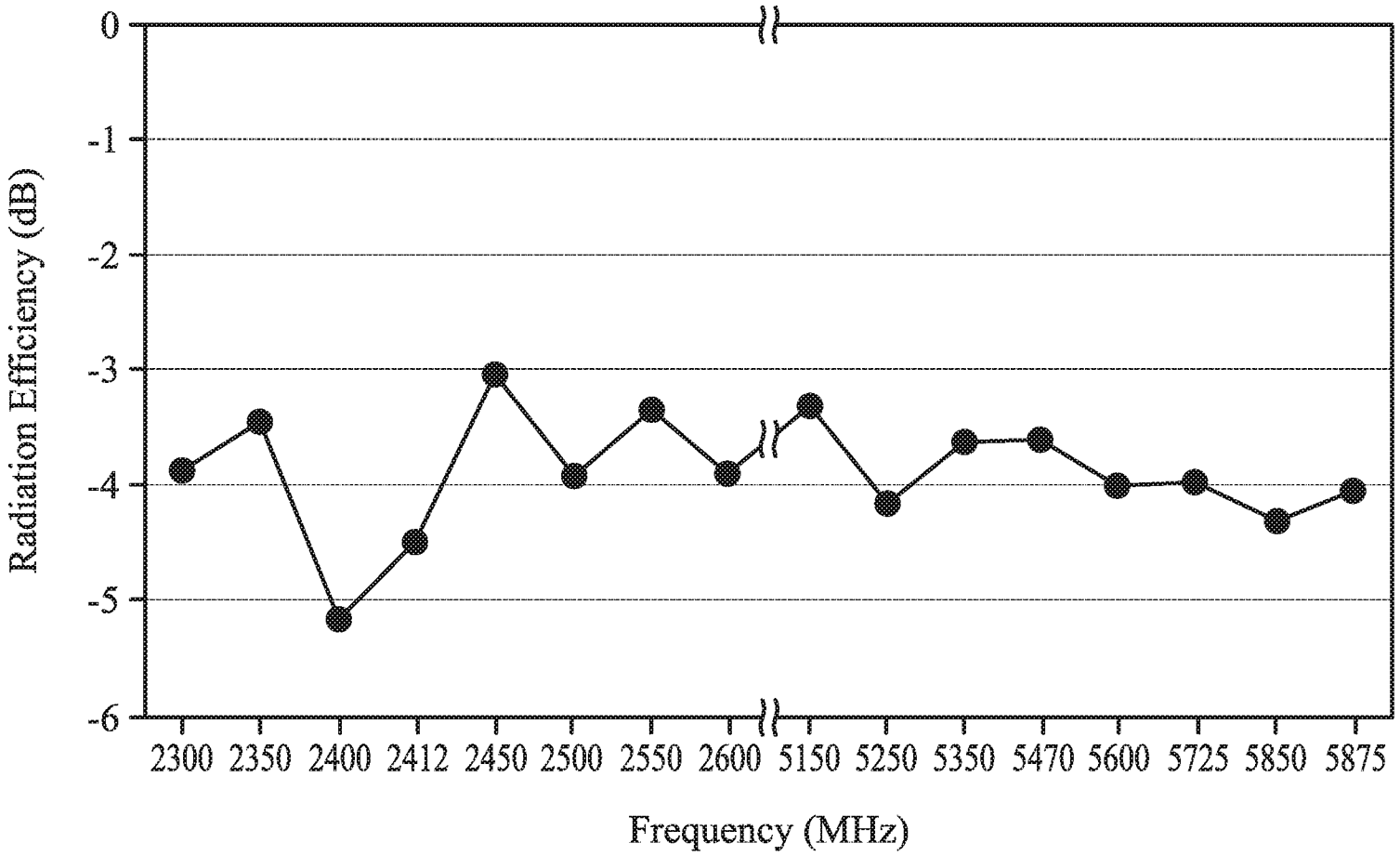
FIG. 5 is a diagram of radiation efficiency of an antenna structure of a mobile device according to an embodiment of the invention.

FIG. 5 is a diagram of radiation efficiency of the antenna structure of the mobile device 100 according to an embodiment of the invention. The horizontal axis represents the operation frequency (MHz), and the vertical axis represents the radiation efficiency (dB). According to the measurement of FIG. 5, the radiation efficiency of the antenna structure of the mobile device 100 can reach −3.5 dB within the third frequency band FB3 and the fourth frequency band FB4, and it can meet the requirement of practical application of general WLAN communication.

Figure 6:
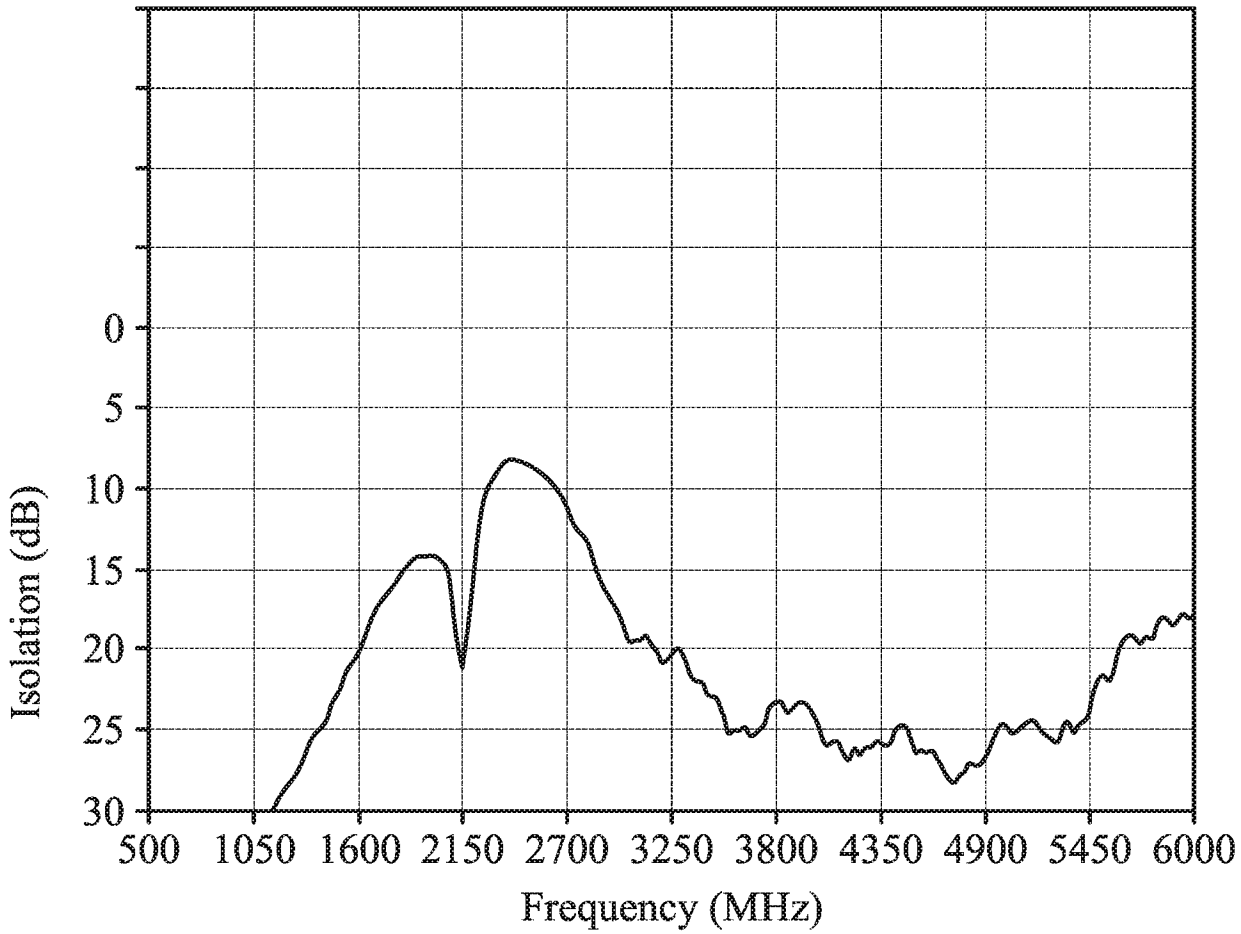
FIG. 6 is a diagram of isolation of an antenna structure of a mobile device according to an embodiment of the invention.

FIG. 6 is a diagram of isolation of the antenna structure of the mobile device 100 according to an embodiment of the invention. The horizontal axis represents the operation frequency (MHz), and the vertical axis represents the isolation (dB). According to the measurement of FIG. 6, when being fed by both the first signal source 191 and the second signal source 192, the antenna structure of the mobile device 100 has isolation which reaches at least 8 dB within the first frequency band FB1, the second frequency band FB2, the third frequency band FB3, and the fourth frequency band FB4. It means that the first signal source 191 and the second signal source 192 do not tend to interfere with each other, thereby improving the whole radiation performance of the antenna structure of the mobile device 100.

In some embodiments, the element sizes of the mobile device 100 are described as follows. The length of the first radiation element 130 (i.e., the length from the first end 131 to the second end 132) may be substantially equal to 0.25 wavelength (λ/4) of the first frequency band FB1 of the antenna structure of the mobile device 100. The length of the second radiation element 140 (i.e., the length from the first end 141 to the second end 142) may be substantially equal to 0.25 wavelength (λ/4) of the second frequency band FB2 of the antenna structure of the mobile device 100. The length of the third radiation element 150 (i.e., the length from the first end 151 to the second end 152) may be substantially equal to 0.25 wavelength (λ/4) of the fourth frequency band FB4 of the antenna structure of the mobile device 100. The total length of the fourth radiation element 160 and the common ground element 110 (i.e., the total length from the first end 111 through the second end 112 and the first end 161 to the second end 162) may be substantially equal to 0.25 wavelength (λ/4) of the third frequency band FB3 of the antenna structure of the mobile device 100. The distance D1 between the first radiation element 130 and the common ground element 110 (or the length of the connection element 120) may be from 2 mm to 3 mm. The width of the coupling gap GC1 (or the distance between the third radiation element 150 and the fourth radiation element 160) may be shorter than or equal to 2 mm. The total length LT of the antenna structure of the mobile device 100 may be shorter than or equal to 30 mm. The total length WT of the antenna structure of the mobile device 100 may be shorter than or equal to 8 mm. The ranges of the above element sizes are calculated and obtained according to many experimental results, and they help to optimize the operation bandwidth and impedance matching of the antenna structure of the mobile device 100.

Figure 7:
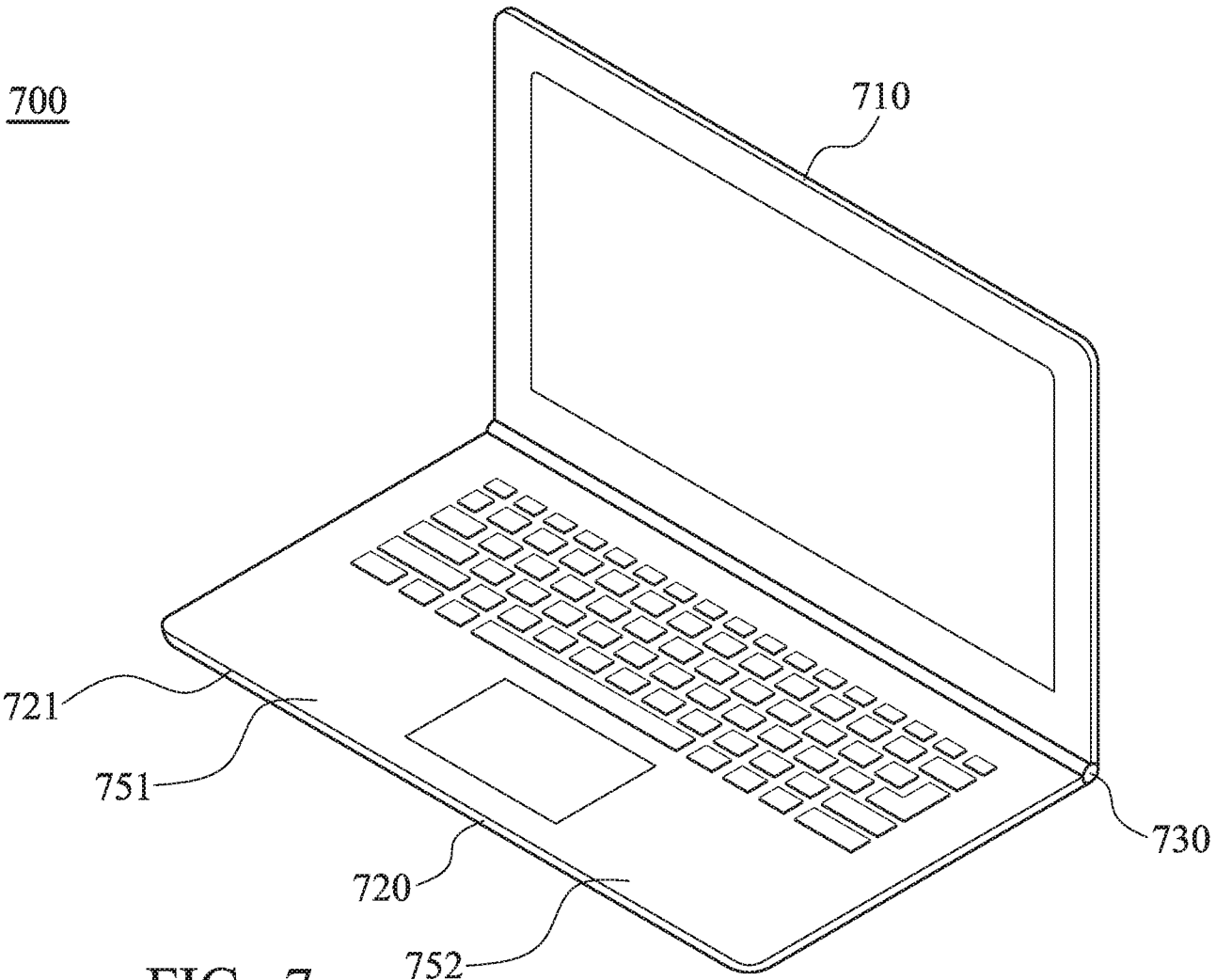
FIG. 7 is a perspective view of a mobile device according to another embodiment of the invention.

FIG. 7 is a perspective view of a mobile device 100 according to another embodiment of the invention. In the embodiment of FIG. 7, the mobile device 100 is a notebook computer which includes an upper cover 710, a base 720, and a hinge element 730. The hinge element 730 is connected between the upper cover 710 and the base 720, so that the notebook computer can operate while open or closed. Specifically, the base 720 has an edge 721, and the aforementioned antenna structure may be disposed inside the base 720 and in a first position 751 or a second positioned 752 adjacent to the edge 721. If the mobile device 100 has a metal housing, antenna windows may be opened and formed on the upper cover 710 and the base 720, and thus the electromagnetic waves of the aforementioned antenna structure can be transmitted through the corresponding antenna windows. Other features of the mobile device 700 of FIG. 7 are similar to those of the mobile device 100 of FIG. 1. Accordingly, the two embodiments can achieve similar levels of performance.

The invention proposes a novel mobile device and a novel antenna structure for covering both WWAN and WLAN operation frequency bands. By incorporating a design with a common ground element, the total area of the proposed wideband antenna structure of the invention is significantly reduced by 50% in comparison to conventional designs (the total length of a conventional integrated WWAN and WLAN antenna can reach 65 mm or longer). In conclusion, invention has the advantages of being small in size and having a wide bandwidth and a low manufacturing cost, and therefore it is suitable for application in a variety of mobile communication devices with narrow borders.

Note that the above element sizes, element shapes, and frequency ranges are not limitations of the invention. An antenna designer can fine-tune these settings or values according to different requirements. It should be understood that the mobile device and antenna structure of the invention are not limited to the configurations of FIGS. 1-7. The invention may merely include any one or more features of any one or more embodiments of FIGS. 1-7. In other words, not all of the features displayed in the figures should be implemented in the mobile device and antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A mobile device, comprising:

a common ground element, coupled to a ground voltage;

a connection element;

a first radiation element, having a first feeding point, wherein the first radiation element is coupled through the connection element to the common ground element;

a second radiation element, coupled to the first feeding point, wherein the second radiation element is at least partially surrounded by the first radiation element;

a third radiation element, having a second feeding point;

a fourth radiation element, disposed adjacent to the third radiation element, wherein the fourth radiation element is coupled to the common ground element; and a dielectric substrate;

wherein an antenna structure is formed by the common ground element, the connection element, the first radiation element, the second radiation element, the third radiation element, and the fourth radiation element;

wherein the antenna structure is disposed on the dielectric substrate;

wherein the antenna structure covers a first frequency band, a second frequency band, a third frequency band, and a fourth frequency band;

wherein the fourth radiation element and the common ground element are excited to generate the third frequency band, and a total length of the fourth radiation element and the common ground element is substantially equal to 0.25 wavelength of the third frequency band.

2. The mobile device as claimed in claim 1, wherein the common ground element substantially has a straight-line shape.

3. The mobile device as claimed in claim 1, wherein the common ground element has a first side and a second side opposite to each other, wherein the connection element, the first radiation element, and the second radiation element are disposed adjacent to the first side of the common ground element, and wherein the third radiation element and the fourth radiation element are disposed adjacent to the second side of the common ground element.

4. The mobile device as claimed in claim 1, wherein the first radiation element substantially has an inverted U-shape defining a notch region.

5. The mobile device as claimed in claim 4, wherein the second radiation element is disposed inside the notch region of the first radiation element.

6. The mobile device as claimed in claim 1, wherein the second radiation element substantially has a C-shape.

7. The mobile device as claimed in claim 1, wherein the third radiation element substantially has a straight-line shape.

8. The mobile device as claimed in claim 1, wherein the fourth radiation element substantially has an inverted C-shape.

9. The mobile device as claimed in claim 1, wherein the fourth radiation element is separate from the third radiation element, and a coupling gap is formed between the third radiation element and the fourth radiation element.

10. The mobile device as claimed in claim 1, wherein the first frequency band is from 1710 MHz to 2170 MHz, the second frequency band is from 2300 MHz to 2700 MHz, the third frequency band is from 2400 MHz to 2500 MHz, and the fourth frequency band is from 5150 MHz to 5850 MHz.

11. The mobile device as claimed in claim 1, wherein the first radiation element is excited to generate the first frequency band, and a length of the first radiation element is substantially equal to 0.25 wavelength of the first frequency band.

12. The mobile device as claimed in claim 1, wherein the second radiation element is excited to generate the second frequency band, and a length of the second radiation element is substantially equal to 0.25 wavelength of the second frequency band.

13. The mobile device as claimed in claim 1, wherein the third radiation element is excited to generate the fourth frequency band, and a length of the third radiation element is substantially equal to 0.25 wavelength of the fourth frequency band.

* * * * *